US010246659B2

(12) United States Patent
Henseler et al.

(10) Patent No.: US 10,246,659 B2
(45) Date of Patent: Apr. 2, 2019

(54) UNLEADED AVIATION FUEL

(71) Applicant: LANXESS Deutschland GmbH, Cologne (DE)

(72) Inventors: Alexander Henseler, Cologne (DE); Torsten Hauschild, Bergisch Gladbach (DE)

(73) Assignee: LANXESS Deutschland GmbH, Cologne (DE)

( * ) Notice: Subject to any disclaimer, the term of this patent is extended or adjusted under 35 U.S.C. 154(b) by 0 days.

(21) Appl. No.: 15/688,000

(22) Filed: Aug. 28, 2017

(65) Prior Publication Data

US 2019/0062657 A1 Feb. 28, 2019

(51) Int. Cl.

| | |
|---|---|
| ***C10L 1/223*** | (2006.01) |
| ***C10L 1/06*** | (2006.01) |
| ***C10L 1/16*** | (2006.01) |

(52) U.S. Cl.

CPC ..... *C10L 1/223* (2013.01); *C10L 1/06* (2013.01); *C10L 1/1608* (2013.01); *C10L 2270/04* (2013.01)

(58) Field of Classification Search

CPC ..... H02M 1/08

See application file for complete search history.

(56) References Cited

U.S. PATENT DOCUMENTS

| | | | | |
|---|---|---|---|---|
| 5,470,358 | A | 11/1995 | Gaughan | |
| 6,258,134 | B1 | 7/2001 | Studzinski et al. | |
| 6,767,372 | B2 | 7/2004 | Barnes et al. | |
| 7,897,034 | B2 | 3/2011 | De Oliveira et al. | |
| 8,628,594 | B1 | 1/2014 | Braly | |
| 2014/0123548 | A1* | 5/2014 | Braly | C10L 1/14 44/426 |
| 2014/0202069 | A1* | 7/2014 | Aradi | C10L 1/14 44/359 |

OTHER PUBLICATIONS

Brown, Jerome E. et al., "Mechanism of Aromatic Amine Antiknock Action", Industrial and Engineering Chemistry, vol. 47, No. 10, Oct. 1955, American Chemical Society, pp. 2141-2146.

European Search Report from European Application No. 16154197, dated Jul. 25, 2016, two pages.

* cited by examiner

*Primary Examiner* — Ellen M McAvoy
*Assistant Examiner* — Chantel L Graham

(57) ABSTRACT

The present invention relates to an aviation gasoline composition, its production and its use in a reciprocating spark ignition aircraft engine.

20 Claims, No Drawings

UNLEADED AVIATION FUEL

BACKGROUND INFORMATION

The present invention relates to a unleaded aviation gasoline composition, its production and its use in a reciprocating spark ignition aircraft engines.

The majority of aviation gas today is unleaded, especially within Europe, but there are still blends for reciprocating spark ignition aircraft engines mainly in America which use leaded fuels in order to increase the octane number. Due to the huge environmental impact of lead there is a strong need for substitution and replacement within non-leaded additives.

As published in Industrial and Engineering Chemistry, 1955, Vol 47, No. 10 pages 2141-2146 "by J. E. Brown et al several amine-containing additives had been tested in anti-knocking analysis, including N-methyl-p-toluidine and N-methyl-m-toluidine.

Several other US-patents disclose the use of at least one aromatic amine, such as U.S. Pat. Nos. 5,470,358 B, 6,258,134 B, 6,767,372 B and 7,897,034 B2 as well as in U.S. Pat. No. 8,628,594.

Some of the most effective anti-knocking agents have a negative impact on the freezing point which is defined in ASTM D 2386-06 and therefore not useful as an aviation fuel.

As best understood, none of the references discloses compositions free of lead and having both a sufficiently low freezing point and a high octane number (effective for unleaded aviation gasoline) and, moreover, which compositions also ensure large scale commercial availability for reasonable prices.

It was therefore an object of the present invention to provide a highly effective high octane unleaded aviation gasoline composition which also fulfills the criteria of a freezing point lower than −58° C.

SUMMARY OF THE INVENTION

Surprisingly, it has been found that a high octane unleaded aviation gasoline composition, comprising certain amounts of at least one unleaded gasoline base fuel, one or more alkylated benzenes; a composition of one or more of iso-pentane, n-butane, and iso-butane, in combination with aromatic amine(s), said aromatic amine(s) comprising N-methyl-p-toluidine and either or both of N-methyl-m-toluidine and m-Toluidine which are present in the ratio of between about four to one (4:1) and twelve to one (12:1) fulfill the above objectives of a high octane number and a low freezing point.

Furthermore, it was also surprisingly found that the combination of N-methyl-p-toluidine with either or both of N-methyl-m-toluidine and m-Toluidine in a ratio between about four to one (4:1) and twelve to one (12:1) has the particular advantage that commercial supplies are optimized. Illustrative of such optimizations is the nitration of toluene resulting in nitro-toluenes, a key ingredient for various industrial intermediates. During the production of toluidines from nitro-toluenes, the isomeric products are produced which themselves can be used in the synthesis of N-methyl-m-toluidine and N-methyl-p-toluidine. The use of N-methyl-p-toluidine and N-methyl-m-toluidine or m-toluidine in the ratio of between about four to one (4:1) and twelve to one (12:1), by weight, thereby ensures the utilization of these compounds at a rate proportional to the production of their precursor molecules that result from the commercial manufacture of nitro-toluenes.

DESCRIPTION OF THE EMBODIMENTS

Thus, in accordance with the present invention, there is an aviation gasoline composition, comprising:

(a) about forty-five percent (45%) to about sixty-five percent (65%) by weight of at least one unleaded gasoline base fuel having a motor octane number of between ninety-seven (97) and ninety-nine point nine (99.9);

(b) about ten percent (10%) to about thirty-five percent (35%), preferably about fifteen percent (15%) to about thirty percent (30%) by weight of one or more alkylated benzenes;

(c) about six percent (6%) to about twelve percent (12%) by weight, collectively, of a selected composition of one or more of iso-pentane, n-butane, and iso-butane; and (d) about four percent (4%) to about fifteen percent (15%) by weight aromatic amine(s), said aromatic amine(s) comprising N-methyl-p-toluidine in combination with either or both of N-methyl-m-toluidine and m-Toluidine and are present in the ratio of between about four to one (4:1) and twelve to one (12:1).

In a preferred embodiment in this gasoline composition said N-methyl-p-toluidine in combination with either or both of said N-methyl-m-toluidine and m-Toluidine are present at the ratio of about four to one (4:1) up to nine to one (9:1), by weight.

Aviation gasoline base fuel is generally described as a gasoline possessing specific properties suitable for fueling aircraft powered by reciprocating ignition engines, e.g. as defined in ASTM D 910-13a.

In a preferred embodiment of the invention compounds (a) include various unleaded aviation gasoline base fuels refined hydrocarbons derived from crude petroleum, a natural gasoline or blends thereof. As generally known to the skilled artisan, aviation gasoline base fuels are normally manufactured by distilling petroleum crude to obtain a distillate with a desired boiling range. Petroleum refining, distillates obtained directly from crude are called straight-run distillates. The hydrocarbon content of a straight-run distillate and, therefore, its octane number, is determined by the composition of the crude. Crudes containing a relatively high proportion of aromatic hydrocarbons yield straight-run gasoline distillates with higher octane numbers than paraffinic crudes. The manufacturing is preferably performed so as to achieve a base fuel having an octane number between 97 and 99.9 by processes known by persons skilled in art.

As is also known, an important ingredient in aviation gasoline base fuels which are inherently present or its amount can be increased by alkylation processes if higher antiknock ratings are required.

The alkylation process can be performed by processing isobutylene with isobutane to result in the predominant isomer being 2,2,4-trimethylpentane (isooctane), which, by definition, has an octane number of 100.

The isobutylene used in this process is usually not pure as the feed typically comes from the catalytic cracking process and may contain propylene, other isomers of butane, and isomers of pentene as well as isoparaffins with carbon numbers from 7 to 12, or even higher, depending on feed composition and reaction conditions.

The higher carbon number isoparaffins are less desirable for aviation gasoline base fuels because of their lower octane numbers and higher boiling points. So, refineries producing aviation gasoline base fuels may distill the alkylate into two cuts, namely, a light alkylate or rerun alkylate, containing isoparaffins with nine carbons or fewer for aviation gasoline base fuels blending, and a heavy alkylate.

Today, aviation gasoline base fuel is a highly refined product specifically manufactured to meet the demanding performance requirements of aircraft engines. Its specifications make it difficult to meet all the requirements with a single refinery stream, even one such as light alkylate produced specially for aviation gasoline base fuels. So aviation gasoline base fuel, like motor gasoline and most other refinery products, is usually produced by blending two or more components to achieve the desired properties.

It is also preferred that said unleaded gasoline base fuel (a) has a motor octane number (MON) of at about ninety-eight (98).

In a preferred embodiment of the invention the alkylated benzenes (b) are mono- di- or trialkylated benzenes. Dialkylated benzenes are preferably selected from the group of xylenes, such as mixtures of two or three of the isomers o-xylene, m-xylene and p-xylene, preferably m-xylene alone. Monoalkylated benzenes are preferably selected from the group of ethyl benzene toluene or mixtures thereof. Preferred examples of trialkylated benzenes are 1,3,5-trimethylbenzene.

For the sake of clarity the alkylated benzenes (b) differ from compound (d) as they do not contain heteroatoms.

In a preferred embodiment of the invention certain di-alkylated and/or tri-alkylated benzenes, such as m-xylene, or 1,3,5-trimethylbenzene are used.

As compound (c), mixtures containing iso-pentane are preferred.

As compound (d), N-methyl-p-toluidine with N-methyl-m-toluidine as well as N-methyl-p-toluidine with m-toluidine is preferred. In another preferred embodiment of the invention d) also comprises N,N-dimethylated-p-toluidine.

In another preferred embodiment of aviation gasoline composition said aromatic amine(s) comprise between about six percent (6%) and about fifteen percent (15%) by weight of said high octane unleaded gasoline.

Another preferred embodiment is that said aromatic amine(s) (d) comprise products from the nitration of toluene, hydrogenation of the resulting products, which thereby forms m-toluidine and p-toluidine which themselves may be further alkylated to produce N-methyl-p-toluidine and N-methyl-m-toluidine. This also may comprise N,N-dimethylated-p-toluidine. If d) comprises N,N-dimethylated-p-toluidine, than the amount preferably does not exceed 5 wt. % of compound d) and in another preferred embodiment is higher than 0.01 wt. %.

In various embodiments, high octane unleaded aviation gasoline blend may have a freezing point at or below minus fifty-eight degrees centigrade (−58° C.).

Another embodiment of the present invention is a method for the manufacture of a high octane unleaded aviation fuel composition according to the invention by blending together each of the compounds (a), (b), (c), and (d) to provide a finished high octane unleaded aviation fuel composition.

The compounds (a), (b), (c), and (d) can be added in various orders during the blending. It is preferred that the compounds (a), (b), (c), and (d) are mixed at temperatures below the lowest boiling point of the selected compounds (a), (b), (c) and (d). It is even more preferred to use temperatures above the melting point of m-toluidine.

Another objective of the present invention is the use of an aviation gasoline composition for operating a reciprocating spark ignition aircraft engine.

The scope of the invention includes all indices, parameters and illustrations, if any, mentioned herein, and those mentioned in preferred ranges with one another, i.e. also any combinations of the respective ranges and preferred ranges.

The examples which follow serve to illustrate the invention but have no limiting effect except as otherwise expressly said forth in the claims.

EXAMPLES

Various blends were formulated while using a standard fuel which falls into the ranges and definitions of claim 1.

This standard fuel was used with different compounds d), such as about 11 wt. % of the mixtures of a) m-toluidine with N-methyl-p-toluidine in a ratio of 1 to 4.
b) N-methyl-p-toluidine and N-methyl-m-toluidine in ratios of 8 to 1 and 9 to 1.

All the unleaded fuel blends comprising compounds (d) showed an increased octane number and freezing points of lower than −58° and were therefore viable alternatives to the standard leaded aviation fuels.

The invention claimed is:

1. A lead-free aviation gasoline composition having a high motor octane number and low freezing temperature, the gasoline comprising:

(a) about forty-five percent (45%) to about sixty-five percent (65%) by weight of at least one unleaded gasoline base fuel having a motor octane number of between ninety-seven (97) and ninety-nine point nine (99.9);
(b) about ten percent (10%) to about thirty-five percent (35%) by weight of one or more alkylated benzenes;
(c) about six percent (6%) to about twelve percent (12%) by weight, collectively, of one or more of iso-pentane, n-butane, and iso-butane; and
(d) about four percent (4%) to about fifteen percent (15%) by weight aromatic-amines, said aromatic amines comprising N-methyl-p-toluidine in combination with at least one of N-methyl-m-toluidine and m-Toluidine, and a ratio of N-methyl-p-toluidine to the at least one of N-methyl-m-toluidine and m-Toluidine is about four to one (4:1) to twelve to one (12:1);

wherein the gasoline has a freezing point of −58° C. or lower.

2. The aviation gasoline as set forth in claim 1, wherein the ratio is about four to one (4:1) to nine to one (9:1), by weight.

3. The aviation gasoline (a) as set forth in claim 1, wherein the gasoline comprises about six percent (6%) to about fifteen percent (15%) by weight of the aromatic amines.

4. The aviation gasoline as set forth in claim 1, wherein the aromatic amines further comprise N,N-dimethylated-p-toluidine.

5. The aviation gasoline as set forth in claim 4, wherein the amount of N,N-dimethylated-p-toluidine does not exceed 5 wt. % of the aromatic amines.

6. The aviation gasoline as set forth in claim 1, wherein the unleaded gasoline base fuel has a motor octane number of about ninety-eight (98).

7. A method for manufacture of the aviation fuel composition according to claim 1, the method comprising blending together components (a), (b), (c), and (d).

8. A method for operating a spark ignition aircraft engine, the method comprising introducing the aviation gasoline composition according to claim 1 into a spark ignition aircraft engine and combusting the gasoline in the engine.

9. The aviation gasoline as set forth in claim 1, wherein component (d) comprises about four percent (4%) to about fifteen percent (15%) by weight of N-methyl-p-toluidine in combination with both N-methyl-m-toluidine and m-toluidine.

10. The aviation gasoline as set forth in claim 1, wherein component (d) comprises about four percent (4%) to about fifteen percent (15%) by weight of N-methyl-p-toluidine in combination with N-methyl-m-toluidine.

11. The aviation gasoline as set forth in claim 9, wherein the ratio of N-methyl-p-toluidine to N-methyl-m-toluidine is 8:1 to 9:1.

12. The aviation gasoline as set forth in claim 1, wherein component (d) comprises about four percent (4%) to about fifteen percent (15%) by weight of N-methyl-p-toluidine in combination with m-Toluidine.

13. The aviation gasoline as set forth in claim 12, wherein the ratio of N-methyl-p-toluidine to m-toluidine is 4:1.

14. The aviation gasoline as set forth in claim 1, wherein the alkylated benzenes comprise mono- di- or trialkylated benzenes, and the gasoline comprises about fifteen percent (15%) to about thirty percent (30%) by weight of the alkylated benzenes.

15. The aviation gasoline as set forth in claim 14, wherein the alkylated benzenes are selected from the group consisting of xylenes, ethyl benzene, toluene, and 1,3,5-trimethylbenzene, and mixtures thereof.

16. The aviation gasoline as set forth in claim 15, wherein:

component (a) has a motor octane number of 88 to 99.9;

component (b) is m-xylene or 1,3,5-trimethylbenzene or a mixture thereof; and component (c) is isopentane.

17. The aviation gasoline as set forth in claim 16, wherein the gasoline comprises about six percent (6%) to about fifteen percent (15%) by weight of component (d), and 0.01 wt % to 5 wt % of component (d) is N,N-dimethylated-p-toluidine.

18. The aviation gasoline as set forth in claim 17, wherein component (d) comprises N-methyl-p-toluidine in combination with both N-methyl-m-toluidine and m-toluidine.

19. The aviation gasoline as set forth in claim 17, wherein component (d) comprises N-methyl-p-toluidine in combination with N-methyl-m-toluidine.

20. The aviation gasoline as set forth in claim 17, wherein component (d) comprises N-methyl-p-toluidine in combination with m-Toluidine.

* * * * *